United States Patent [19]

Ede et al.

[11] Patent Number: 4,527,605

[45] Date of Patent: Jul. 9, 1985

[54] WORKBENCHES

[75] Inventors: Douglas F. C. Ede, Tunbridge Wells; Brian S. Wilkinson; Colin B. Mynott, both of Newmarket, all of England

[73] Assignee: Newjig Limited, Tunbridge Wells, England

[21] Appl. No.: 493,255

[22] Filed: May 10, 1983

[30] Foreign Application Priority Data

Dec. 13, 1982 [GB] United Kingdom ..... 8235487

[51] Int. Cl.[3] ..... B25H 1/04

[52] U.S. Cl. ..... 144/286 R; 83/468; 83/574; 144/136 C; 269/93; 269/303

[58] Field of Search ..... 144/1 R, 134 R, 136 R, 144/134 D, 136 C, 286 R; 83/456, 468, 574, 745; 269/93, 229, 303, 304; 108/13, 157

[56] References Cited

U.S. PATENT DOCUMENTS 2,911,017 11/1959 Holder ..... 83/574
4,018,120 4/1977 Pastore ..... 83/468
4,105,055 8/1978 Brenta ..... 144/134 D
4,111,088 9/1978 Ziegelmeyer ..... 83/468
4,133,237 1/1979 Lewin ..... 83/574
4,186,784 2/1980 Stone ..... 144/1 R

FOREIGN PATENT DOCUMENTS 1267032 3/1972 United Kingdom .

*Primary Examiner*—W. D. Bray
*Attorney, Agent, or Firm*—Fleit, Jacobson, Cohn & Price

[57] ABSTRACT

A bench having a horizontal working surface and a fence at the rear edge which defines a straight edge. The fence includes a forwardly extending ledge which overhangs the rear portion of the working surface. The working surface can be raised and lowered, so that a workpiece on the working surface can be releasably clamped between the ledge and the working surface. A bridge is secured to the fence and includes guide rails extending forwardly accurately perpendicular to the fence to guide a carriage on which can be mounted a power tool, such as a router, e.g. to form an accurate edge on the workpiece.

5 Claims, 7 Drawing Figures

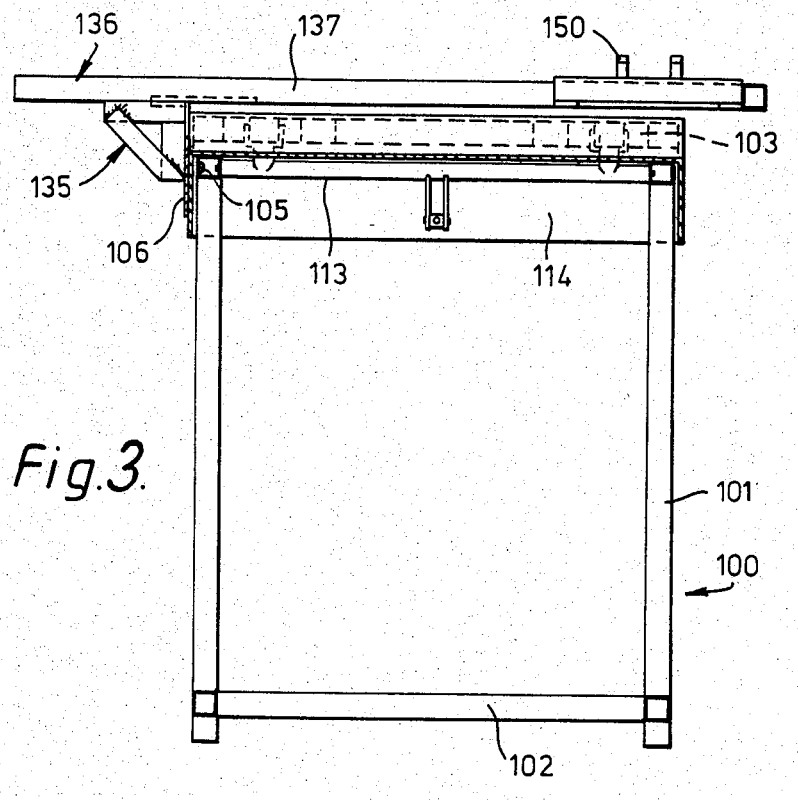
Fig.3.
Fig.4.
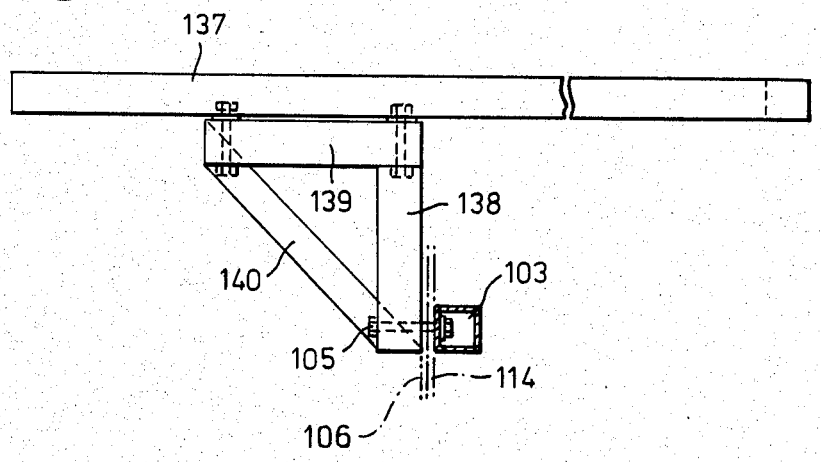

WORKBENCHES

The present invention relates to workbenches.

Various proposals have been made for the construction of workbenches. For example, British Patent Specification No. 1267032 discloses a workbench including a pair of elongate vice members having their upper surfaces lying in substantially the same horizontal plane to form a working surface, the members being supported from below by a supporting structure. These elongate vice members are of a relatively simple construction, effectively in the form of two planks of wood, and the planks of wood are used to support the workpiece on the upper surface, a facility being provided for clamping the workpieces by inserting pegs in holes in the plank-like vice members, the pegs having heads which overlie the edge of the workpiece. Alternatively, one can clamp the workpiece between the facing side edges of the plank-like vice members. Provision is made for the planks to be moved either parallel to one another or at an angle at one another, since there are provided two operating screws, one adjacent each end of a pair of vice members.

While this is very satisfactory for many uses, the structure is not capable of holding large workpieces and clamping them firmly. Provision has been made with a structure such as shown in Specification No. 1267032 to extend the upper surface area, but this is not entirely satisfactory. Furthermore, no provision is made for accurately mounting a tool on the workbench provided.

It is now proposed, according to the present invention, to provide a bench comprising a frame, a substantially horizontal working surface mounted on said frame, a fence secured to the frame and defining a substantially straight edge adjacent the rear side of the working surface, a ledge mounted to said fence and extending over a portion of the working surface, a bridge secured to the frame and including forwardly extending guides which extend accurately perpendicular to the straight edge defined by the fence, a carriage slidable along said guide and adapted to carry a power tool, the fence, the ledge and the bridge being secured to the frame in a rigid manner and means to cause the working surface to be raised and lowered relative to the frame, and thus relative to the fence, the bridge and the ledge, so that a workpiece on the working surface may be releasably clamped between the ledge and the working surface.

The working surface is advantageously in the form of a large table-like structure, which can have a central groove extending from the front to the back for a reason to be explained later.

The advantage of the structure of the present invention is that a very large workpiece can be placed on the working surface and can be clamped accurately with a datum surface of the workpiece against the fence.

Preferably the ledge is formed integrally with the fence. In one particular structure the ledge and the fence are both continuous elements, thus being of "angle iron" structure. The ledge may be provided with a series of accurately spaced vertical holes to enable one or more pegs to be placed therethrough for accurately positioning a workpiece.

A further clamp could be provided on the bridge at the front and/or on the carriage which is movable along the guide or guides of the bridge, to enable the workpiece to be clamped not only at the back by the ledge, but also at the front.

In a presently preferred construction, the working surface forms the top of a table, the vertical position of which can be adjusted. An example of a mechanism for achieving this includes a threaded shaft, which is rotatable by means of a handle engaging a nut carried by a crank mounted on one of two generally horzontally extending cross-shafts. Each cross-shaft carries two parallel radially extending arms each having a roller on its free end engageable with the undersurface of the table, the two cross-shafts being connected by a rod journalled to the crank mounted on each cross-shaft. Rotation of the handle will cause the nut to move, thus pivoting the two cross-shafts and the arms carried thereby. This will cause raising or lowering of the table, so that its upper surface remains horizontal.

The table may be formed as a glass reinforced plastic structure having a peripheral skirt and longitudinally extending metal rails on its undersurface to rigidify it. The rails, which may be profiled, e.g. of top-hat section, can also act as tracks for the rollers. Bolts which hold the fence to the frame may pass through vertical slots in the skirt and act to guide the table during its vertical movement.

The carriage is advantageously provided with a symmetrical, e.g. square, recess in its upper surface which is capable of accommodating a similarly shaped plate on the tool. This enables the tool to be mounted in two orientations accurately perpendicular to one another. Thus, for example, if the tool is a saw it can be used to cut the workpiece from front to back, by moving the carriage along the guide, or it could be used to cut parallel to the fence by locking the carriage on the guide and moving the workpiece relative to the tool while abutting the fence.

When moving a saw or other tool from front to back the tool can pass through the central groove referred to earlier. When using a saw to cut parallel to the fence, the lower part of the saw can be accommodated in the slot or a further slot extending parallel to the fence.

To assist in this movement of the workpiece while abutting the fence, there may be provided a pusher member comprising a strip of material which is sufficiently thin to pass readily under the bridge when the ledge is clamping the workpiece, and this strip of material is provided with at least two spaced resiliently urged rollers on its side edge, the rollers being engageable against the edge of the workpiece parallel to the edge abutting the fence. The rollers will push the workpiece against the fence and will allow the workpiece to move readily parallel to the fence.

In order that the present invention may more readily be understood, the following description is given, merely by way of example, reference being made to the accompanying drawings, in which:

FIG. 3 is an end elevation taken in section of the construction of FIGS. 1 and 2;

FIG. 4 is an enlarged side elevation showing the support for the bridge;

Referring now to the construction illustrated in FIGS. 1 to 4, the workbench comprises a frame which is generally rectangular and comprises four legs 101, four bottom horizontally extending brace members 102 and four upper brace members 103. The frame is thus of a robust generally rectangular construction.

Figure 1:
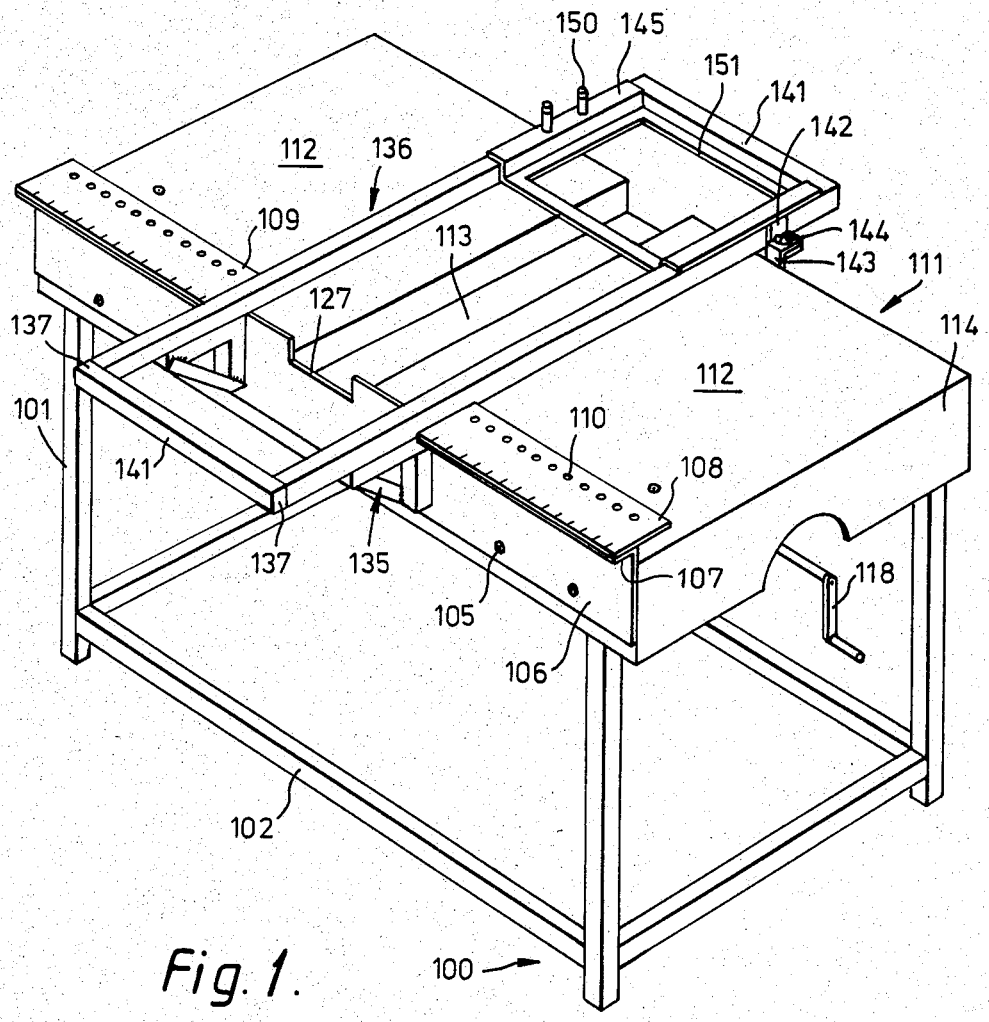
FIG. 1 is a perspective view from above, the rear and one side of one embodiment of work bench according to the invention.

As can be seen from FIG. 1 a fence 106 is bolted to the rear frame member by six bolts 105, the fence itself extending vertically upwardly and being provided with an upper flange 107. Secured, e.g. by welding or bolting, to this flange 107 are two flat plates 108, 109 which form a ledge which is generally horizontally extending. A large number of holes 110 are arranged linearly and preferably equidistantly along the ledge 108, 109 parallel to the fence 106.

Mounted over the upper brace members 103 is a table 111, this having an upper working surface 112 and a central linear channel 113 forming a groove extending from back to front of the bench. The table 111 is formed as a moulding from glass fibre reinforced plastics material and is provided with a peripheral skirt 114 which extends downwardly through the upper parts of the legs 101. In order to allow a bolt 105 to pass, the skirt at the rear of the table is formed with six vertically extending slots 115.

Figure 2:
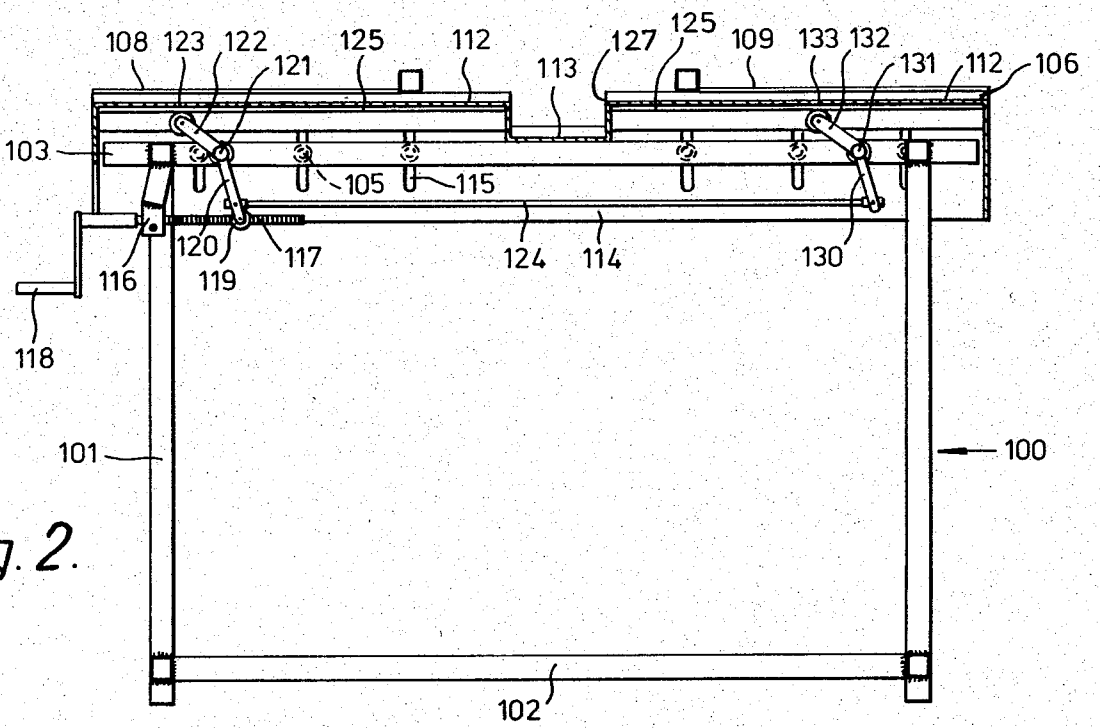
FIG. 2 is a front elevation of the workbench taken in section of the construction of FIG. 1.

Secured to one of the cross braces 103 is a depending support 116 which is provided with a bearing (not shown) for a generally horizontally extending threaded shaft 117 which can be rotated by means of a handle 118. A nut 119 is threaded onto the shaft 117 and is carried by a first crank 120 which is mounted on a cross-shaft 121 which extends from front to back of the bench and is capable of pivoting about its axis. The cross-shaft carries two spaced apart arms 122 on which is rotatably mounted a roller 123 which runs on a lower surface of the table 111. Preferably the table is provided with four metal rails 125 which extend from left to right, as seen in FIG. 2, and first of all act to strenghten the work table and secondly so as to form a track along which the roller 123 may run.

Journalled to the crank 120 is a connecting rod 124 which is also journalled to a further crank 130 carried by a shaft 131 having an arm 132 with a roller 133. Thus, rotation of the handle 118, and thus of the shaft 117, will cause the nut 119 to move to the left or right, as seen in FIG. 2, thus rocking the crank 120 and also the crank 130 in either a clockwise or anticlockwise direction. As shown, if it is rocked in a clockwise direction the rollers 123 will cause the table to be raised. It will be appreciated that if a workpiece is placed on the working surface 112 and pushed under the ledge 108, 109, if the handle 118 is operated in this way, the working surface will rise and will clamp the workpiece under the ledge 108,109. From FIG. 1 it will be noted that the fence 106 has a recess 127 aligned with the channel 113.

A cantilever mounting arrangement 135 (FIG. 3) is used to support a bridge 136 consisting of two parallel square cross-section guide rails 137. The cantilever support arrangement is shown more clearly in FIG. 4, and it will be seen that two of the bolts 105 carry a triangular bracket consisting of an upright 138, a horizontal bar 139 and a hypotenuse bar 140. These can, in fact, be made rather larger than illustrated in the drawings if desired. Bolted to the member 139 are the two rails 137 which are joined at the back and front by braces 141. FIG. 1 shows one of two small brackets 142 secured one to the outside of each of the guide rails 137. Engageable with these brackets are latch members 143 which can be secured to the brackets by means of bolts and wing nuts 144. This will normally keep the bridge absolutely rigid and horizontal. In certain circumstances it may be necessary to insert a very large workpiece in which case the wing nuts 144 can be released and the latches 143 pivoted out of the way. The cantilever arrangement 135 will normally be sufficiently strong to carry the bridge even with the latches 143 disconnected, particularly when a workpiece is mounted closely under the guide rails 137.

Slidable longitudinally of the guide rails 137 is a carriage 145 which has small plates (not shown) which extend under the guide rails so that the carriage is captive thereon.

The guide rails are provided with several equally spaced vertical holes (not shown) into which can be inserted spring loaded pins 150 to hold the carriage in any desired position. It will be noted that the carriage has a generally square hole 151 therein. Into the square hole may be placed the router or saw having a square mounting plate but preferably a slightly different arrangement is provided in which while a square plate is inserted, this square plate itself has, in effect, a rotary turntable upon which the tool may be mounted so that the tool can take up any desired angle.

In use, a workpiece may be placed on the working surface and pushed against the fence. Thereafter the handle 118 can be operated to cause the working surface 112 to be raised so that the ledge 108,109 will clamp on the workpiece and hold it firmly. Before this is done, a slider (not shown) on the fence can be moved to a suitable position and locked by passing a pin (not shown) through one of the holes 110 at a particular position, thus accurately to locate the workpiece.

One can then carry out, for example, a transverse saw cut on the workpiece and then the finished product can be produced with a router mounted on the carriage, the router giving a very accurate finished surface which is perpendicular to the edge and the faces of the workpiece board.

Figure 5:
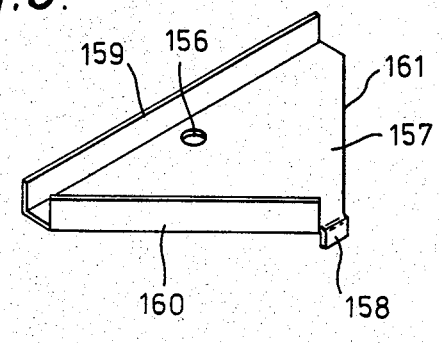
FIG. 5 is a perspective view of a clamping member.
Figure 6:
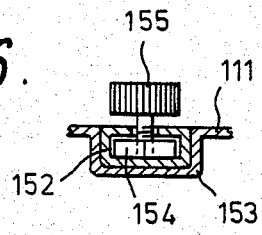
FIG. 6 is a scrap section showing the means for securing the clamping member in place.

The table 111 is preferably provided with two front to back extending tracks of dovetail or channel section, these not being shown in FIG. 1 for the sake of clarity, but they run in the table substantially parallel to the rails 137. A particular form of this track is illustrated in FIG. 6 by the reference numeral 152. It will be seen that the track 152 is inserted in a recess portion 153 of the table 111 and it has inserted therein a nut 154 into which is threaded a knurled bolt 155. This can be used to secure a clamping device as illustrated in FIG. 5, the bolt 155 passing through an aperture 156 in the generally triangular bottom plate 157 of this clamp. The forward edge of the clamp has a downturned tab 158 and the rear wall 159 and the left side angled wall 160 include upturned flanges while the third side 161 does not. In use of this clamping arrangement the tab 158 can be abutted against the front edge of the table 111 and the knurled bolt 155 tightened to secure it in place. If it is desired, for example, to make a mitre cut on the end of a workpiece at 45° then the workpiece is slid along the flange 160 relative to a saw. Alternatively the workpiece can be slid along the flange 159 generally parallel to the fence to make a longitudinal cut therein.

Figure 7:
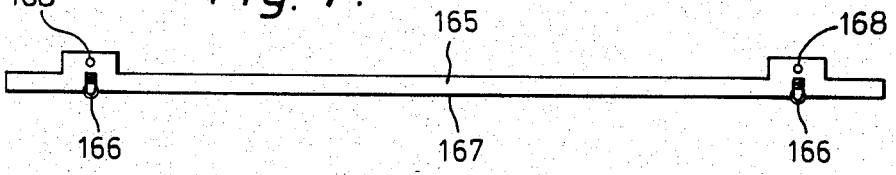
FIG. 7 is a top plan view of one form of pusher member.

An alternative clamping arrangement is illustrated in FIG. 7 and includes a strip 165 which is of substantially the same length as the table 111 and it is provided with two sprung loaded rollers 166. The bolts 155 are passed through apertures 168 in strip 165 and slid to the appropriate position on the tracks 152 and the strip 165 is clamped so that its edge 167 is substantially parallel to the fence. The actual position is adjusted to suit the particular workpiece with which one is starting and this workpiece is thus urged by the sprung loaded rollers 166 against the fence. This can be used to make a ripsaw cut or a routing action on the longitudinal edge of the workpiece.

I claim:

1. A bench comprising a frame, a substantially horizontal working surface mounted on said frame, a fence secured to the frame and defining a substantially straight edge adjacent the rear side of the working surface, a ledge mounted to said fence and extending over a portion of the working surface, a bride secured to the frame and including forwardly extending guides which extend accurately perpendicular to the straight edge defined by the fence, a carriage slidable along said guides and adapted to carry a power tool, the fence, the ledge and the bridge being secured to the frame in a rigid manner and means to cause the working surface to be raised and lowered relative to the frame, and thus relative to the fence, the bridge and the ledge, so that a workpiece on the working surface may be releasably clamped between the ledge and the working surface.

2. A bench as claimed in claim 1, wherein said means comprise arms pivotally mounted about horizontal axes on said frame, rollers mounted at the upper ends of said arms, a connecting rod interconnecting said arms, a shaft threadably connected to one of said arms and a handle to rotate the shaft, whereby rotation of the handle causes simultaneous pivoting of the arms effective to raise and lower the rollers, the undersurface of the working surface resting on said rollers, so as to be raised and lowered therewith.

3. A bench as claimed in claim 2, further comprising a table formed of glass fibre reinforced plastic and including a depending peripheral strengthening skirt and metal rails located on the undersurface of said table located to form tracks on which said rollers run and wherein said working surface is the upper surface of said table.

4. A bench as claimed in claim 3 and further comprising means defining vertical slots in said peripheral skirt and bolts passing through said slots effective to secure said fence to the frame and to serve to guide the table for vertical movement.

5. A bench as claimed in claim 1, and further comprising a pusher member including an elongate strip sufficiently thin to pass under the bridge, spaced spring loaded rollers in the rear edge of the strip and means to clamp the strip so that the rollers are equally spaced from the fence, to enable them to urge a workpiece against the fence while it is being pushed parallel to the fence.

* * * * *